US007998260B2

(12) United States Patent
Ni

(10) Patent No.: US 7,998,260 B2
(45) Date of Patent: Aug. 16, 2011

(54) CYCLONE SILENCER OF CLEANER AND DUST REMOVING DEVICE HAVING THE SAME

(75) Inventor: Gen Zu Ni, Suzhou (CN)

(73) Assignee: Suzhou Kingclean Floorcare Co., Ltd., Suzhou (CN)

( * ) Notice: Subject to any disclaimer, the term of this patent is extended or adjusted under 35 U.S.C. 154(b) by 288 days.

(21) Appl. No.: 12/308,986

(22) PCT Filed: Jun. 11, 2007

(86) PCT No.: PCT/CN2007/001845

§ 371 (c)(1),
(2), (4) Date: Dec. 31, 2008

(87) PCT Pub. No.: WO2008/006280

PCT Pub. Date: Jan. 17, 2008

(65) Prior Publication Data

US 2009/0249577 A1 Oct. 8, 2009

(30) Foreign Application Priority Data

Jul. 3, 2006 (CN) ..... 2006 1 0086313
Sep. 21, 2006 (CN) ..... 2006 1 0096159

(51) Int. Cl.
*B01D 39/00* (2006.01)

(52) U.S. Cl. ..... 96/380; 55/343; 55/345; 55/346; 55/424; 55/426; 55/428; 55/429; 15/326; 96/381; 96/382

(58) Field of Classification Search ..... 55/343, 55/345, 346, 424, 426, 428, 429; 15/326; 96/380, 381, 382, 385, 387, 384
See application file for complete search history.

(56) References Cited

U.S. PATENT DOCUMENTS

| | | | | | |
|---|---|---|---|---|---|
| 2,771,157 | A | * | 11/1956 | Gustavsson | 138/44 |
| 2,936,043 | A | * | 5/1960 | Armstrong et al. | 55/416 |
| 5,067,584 | A | * | 11/1991 | Williams et al. | 181/231 |
| 5,159,738 | A | * | 11/1992 | Sunagawa et al. | 15/326 |
| 5,180,257 | A | * | 1/1993 | Narishima et al. | 406/173 |
| 5,513,417 | A | * | 5/1996 | Kim et al. | 15/326 |
| 6,679,930 | B1 | * | 1/2004 | An et al. | 55/337 |
| 6,932,188 | B2 | | 8/2005 | Ni | |
| 7,410,535 | B2 | * | 8/2008 | Song et al. | 96/385 |
| 7,513,924 | B2 | * | 4/2009 | French et al. | 55/459.1 |
| 7,556,661 | B2 | * | 7/2009 | Jeong et al. | 55/343 |
| 7,637,991 | B2 | * | 12/2009 | Eddington et al. | 96/385 |
| 2006/0037479 | A1 | * | 2/2006 | Song et al. | 96/385 |
| 2006/0179802 | A1 | * | 8/2006 | French et al. | 55/459.1 |
| 2007/0144116 | A1 | * | 6/2007 | Hong et al. | 55/345 |
| 2008/0256911 | A1 | * | 10/2008 | Oh et al. | 55/346 |

FOREIGN PATENT DOCUMENTS

| | | | |
|---|---|---|---|
| CN | 1739441 | A | 3/2006 |
| EP | 0888742 | A1 | 1/1999 |
| EP | 0910980 | A2 | 4/1999 |
| JP | 2002-330901 | A | 11/2002 |

* cited by examiner

*Primary Examiner* — Jason M Greene
*Assistant Examiner* — Dung Bui
(74) *Attorney, Agent, or Firm* — Bacon & Thomas, PLLC

(57) ABSTRACT

A cyclone silencer of cleaner includes an outlet pipe(2) partially inserted into a cyclone cylinder (1). Ribs (3) are arranged on the lower edge of said outlet pipe (2) and extend downwardly to reduce noise.

13 Claims, 6 Drawing Sheets

CYCLONE SILENCER OF CLEANER AND DUST REMOVING DEVICE HAVING THE SAME

FIELD OF THE INVENTION

The present invention relates to a cyclone silencer of cleaner and a dust remover having the same.

BACKGROUND OF THE INVENTION

A traditional vacuum cleaner is provided with a filter, so as to filter the inhaled dirty air and leave the dust grain in a dust collector. Therefore, the filter of such a vacuum cleaner should be cleaned or replaced after being used for a period of time. Otherwise, resistance of the vacuum motor will be increased after the filtering hole of the filter is blocked by thin dust, and even worse the motor will be burnt, which will not only bring trouble to the customer, but also affect performance and life of the vacuum cleaner.

In recent years, the manufacturers substitute a cyclone dust remover for the filter according to the principle of cyclone separation, and obtain a better dust removal result, the cyclone dust remover having therefore been widely applied to the vacuum cleaners. As shown in FIG. 1, this cyclone dust remover is provided inside a dust cup with a conical cyclone cylinder, which is provided at the upper end with an outlet pipe in the longitudinal direction, which is communicated with an air outlet of the dust cup; the cyclone cylinder is provided at the lower end with an opening, such that dust can fall into a dust-collecting box at bottom of the dust cup; an inlet pipe enters along the upper sidewall of the cyclone cylinder in the tangential direction, making gas stream included with dust produce cyclone in the cyclone cylinder; the dust grains fall to bottom of the dust-collecting box along the sidewall of the cyclone cylinder under the centrifugal force, and the gas stream after dust removal is discharged upwards out of the dust cup via the outlet pipe.

However, some shortcomings have also been found with this cyclone device in practical application: First, the outlet pipe may produce a high-frequency noise while working; second, because the height of the cyclone inlet is equivalent to that of the outlet pipe, the air entering from the cyclone inlet collides on the side of the outlet pipe, and may collide with the air lately entering from the cyclone inlet before revolving down to the conical tube body, which thus produces a noise.

SUMMARY OF THE INVENTION

A purpose of the present invention is to provide a cyclone silencer of cleaner and a dust remover having the same, the cyclone silencer being provided with ribs along the lower edge of an outlet pipe, thus the noise being lowered.

TECHNICAL SOLUTION OF THE INVENTION

One of the technical solutions of the present invention is as below: A cyclone silencer of cleaner is provided, which includes an outlet pipe partly extended into a cyclone cylinder; the outlet pipe is provided at the lower edge with some parallel spaced ribs extending downwards, between the lower ends of which is connected a connection ring; the rib and the lower head face of the outlet pipe form an angle smaller than or equal to 90 degrees, the rib being of an arc form, the outlet pipe being provided on the outer wall with a helicoid orientated downwards.

A dust removing device of cleaner is provided, which includes a cyclone cylinder, communicated with which are a cyclone inlet and an outlet pipe; the outlet pipe is positioned longitudinally, and provided at the lower edge with some parallel spaced ribs extending downwards; the spacing between the adjacent ribs is smaller than the length of each rib, and bigger than the width of each rib; the rib is fixedly connected at the lower end with a connection ring, whose diameter is smaller than that of the outlet pipe; the extension direction of the rib and the longitudinal axis direction of the outlet pipe may either form an acute angle or be the same. A second technical solution of the present invention is as below: A cyclone silencer of cleaner is provided, which includes an outlet pipe partly extended into the cyclone cylinder; the outlet pipe is provided at the lower edge with some parallel spaced ribs extending downwards; the rib and the lower head face of the outlet pipe form an angle smaller than or equal to 90 degrees, the rib being of an arc form.

A dust removing device of cleaner is provided, which includes a cyclone cylinder, communicated with which are a cyclone inlet and an outlet pipe; the outlet pipe is positioned longitudinally, and provided at the lower edge with some parallel spaced ribs extending downwards; the spacing between the adjacent ribs is smaller than the length of each rib, and bigger than the width of each rib; the extension direction of the rib and the longitudinal axis direction of the outlet pipe may either form an acute angle or be the same.

THE ADVANTAGES OF THE INVENTION

1. The present invention provides some ribs extending downwards along the lower edge of the outlet pipe, and the ribs are spaced from each other; gas stream will contract when entering the space of the ribs and expand when getting out of the space of the ribs, thus noise of the gas stream being lowered.

2. The present invention further provides the helicoid oriented downwards on the side of the outlet pipe, making the air entering from the cyclone inlet form cyclone quickly and flow downwards, preventing it from colliding with the air entering afterwards, thus likewise lowering the noise.

THE PRESENT INVENTION WILL BE FURTHER DESCRIBED IN CONJUNCTION WITH THE DRAWINGS AND THE EMBODIMENTS

Figure 1:
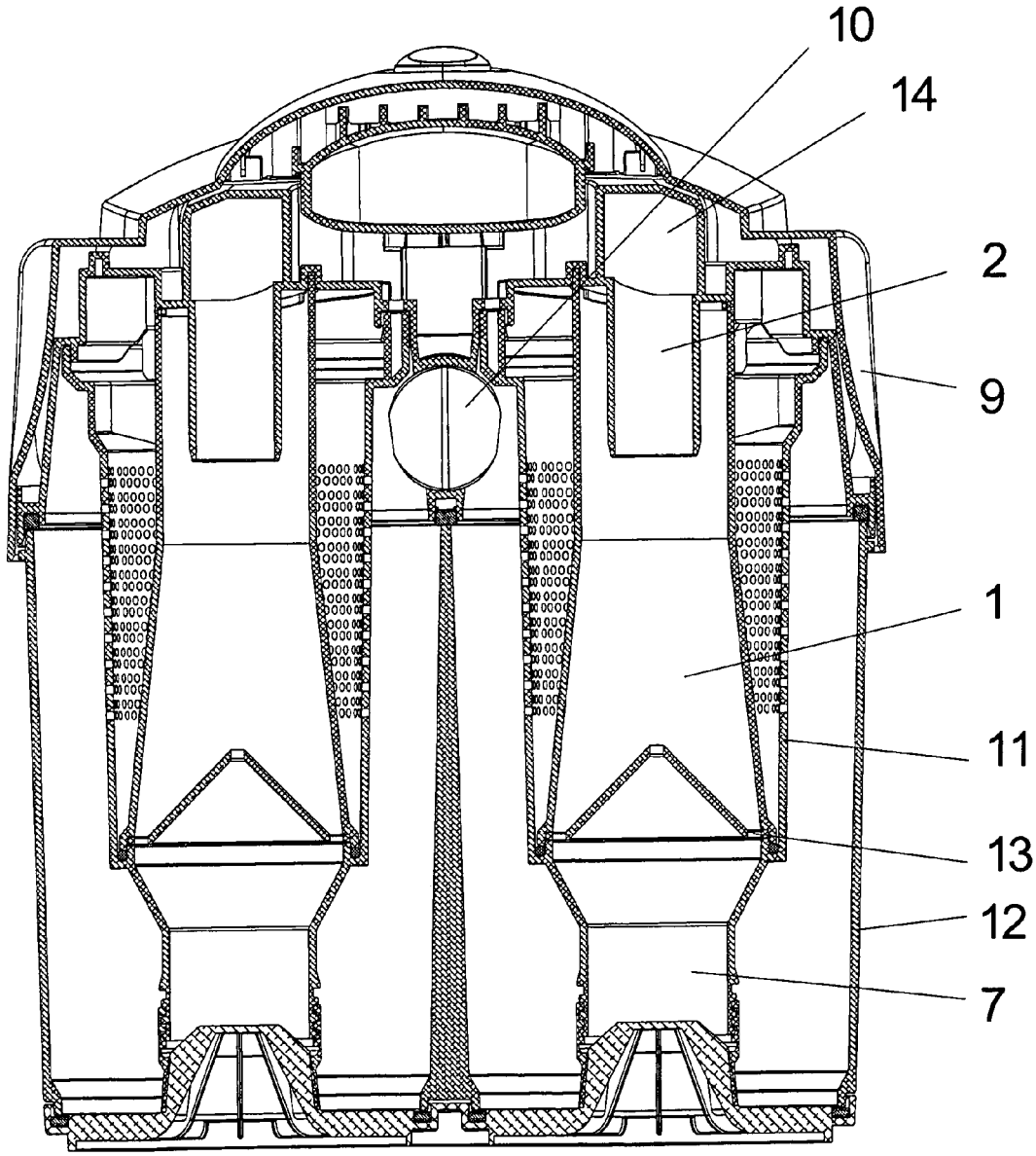
FIG. 1 is a structural schematic view of Embodiment 1 of the prior art.

In the drawings: 1. Cyclone cylinder; 2. outlet pipe; 3. rib; 4. connection ring; 5. helicoid; 6. cyclone inlet; 7. dust-collecting bucket; 8. inlet pipe; 9. cup cover; 10. air inlet; 11. filtering tube; 12. cup body; 13. dust-falling ring gap; 14. air outlet; 15. primary air inlet; 16. primary dust cup; 17. tube body; 18. filtering tube; 19. notch; 20. primary air outlet; 21. strainer; 22. communicating layer; 23. secondary air inlet; 24. dust-falling ring gap; 25. secondary dust cup; and 26. outlet layer.

DETAILED DESCRIPTION OF THE EMBODIMENTS

Embodiment 1

Figure 2:
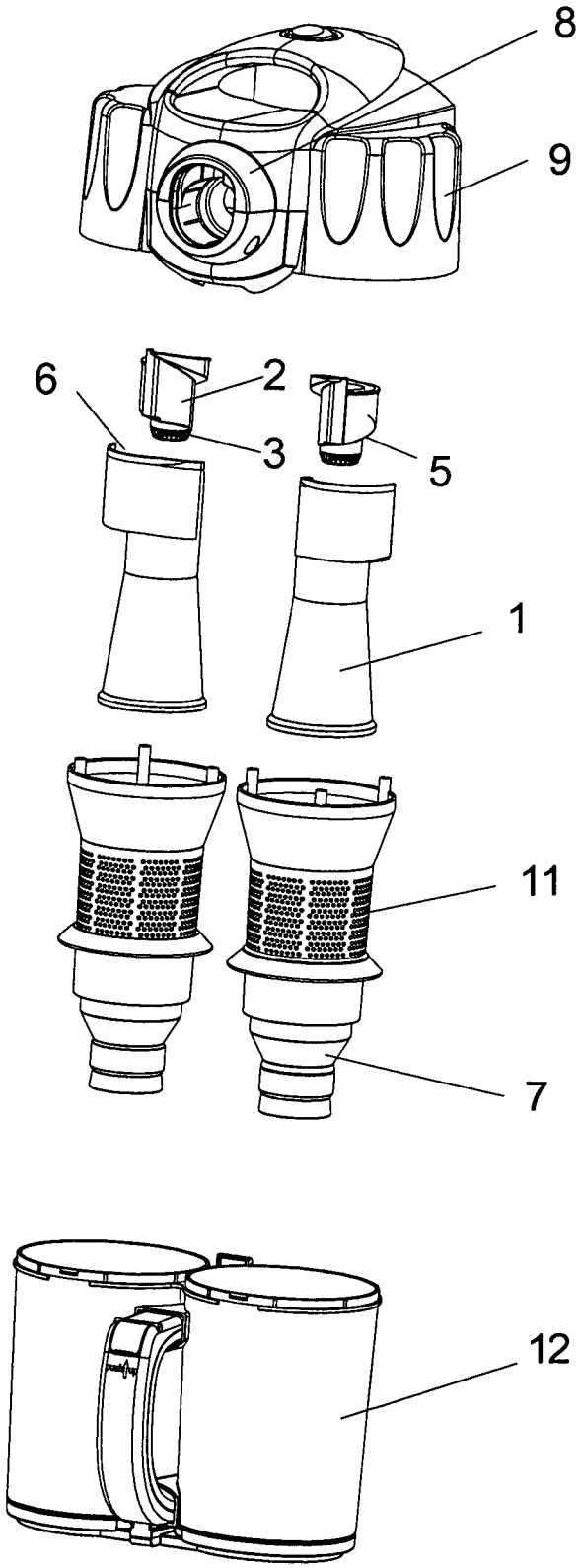
FIG. 2 is an assembly drawing of Embodiment 1.
Figure 3:
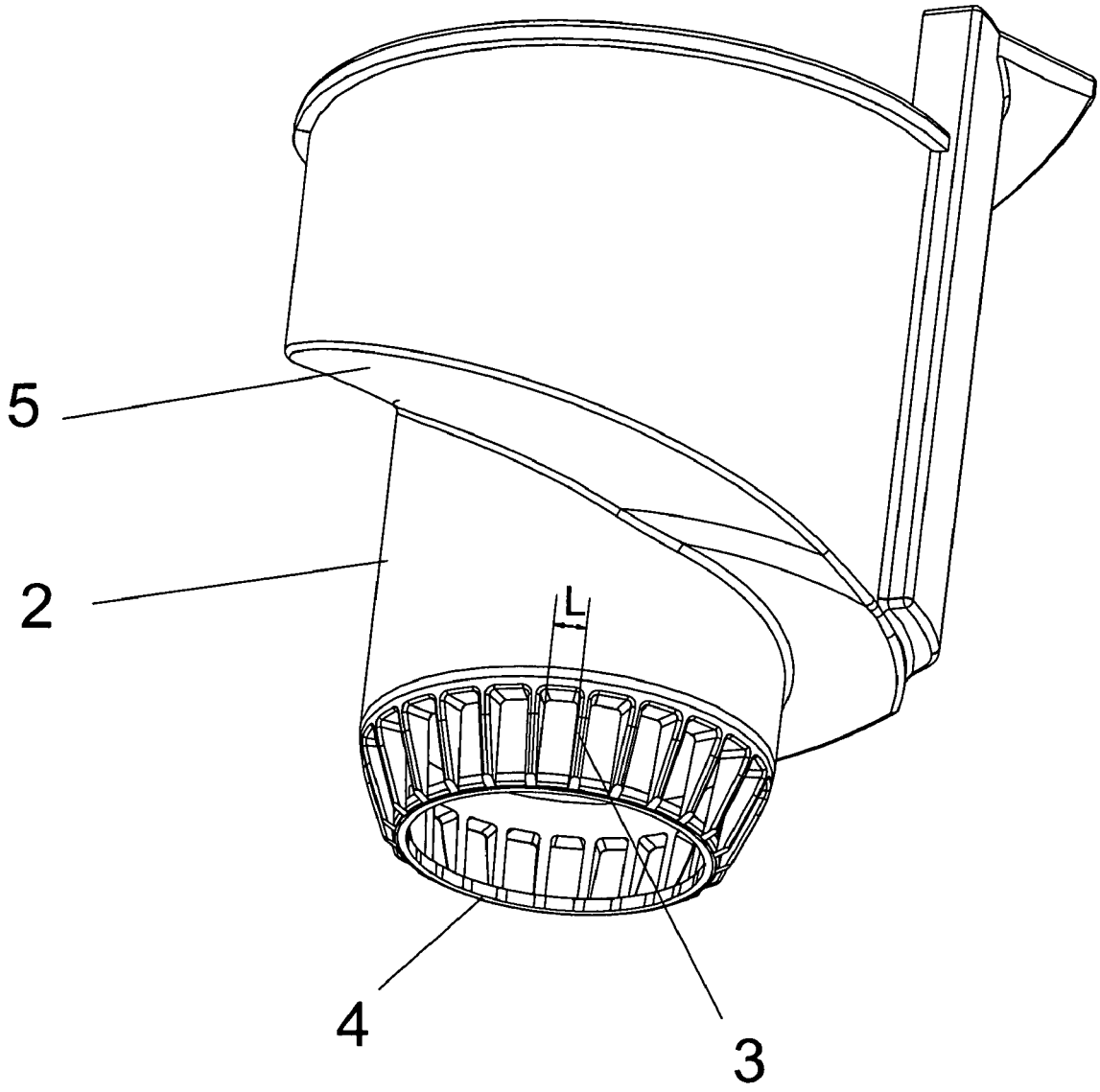
FIG. 3 is a schematic view of the outlet pipe of Embodiment 1.

As shown in FIGS. 1 to 3, a cyclone silencer of cleaner is provided, which includes an outlet pipe 2 partly extended into a cyclone cylinder 1; the outlet pipe 2 is provided on the outer wall with a helicoid 5 orientated downwards, and at the lower edge with some parallel spaced arc ribs 3*s* extending downwards, between the lower ends of which is connected a connection ring 4; the rib 3 and the lower head face of the outlet pipe 2 form an angle smaller than or equal to 90 degrees.

A dust removing device of cleaner is provided, which includes a cyclone cylinder 1, communicated with which are a cyclone inlet 6 and an outlet pipe 2; the outlet pipe 2 is positioned longitudinally, and provided at the lower edge with some parallel spaced ribs 3*s* extending downwards; the spacing between the adjacent ribs 3*s* is smaller than the length of each rib 3, and bigger than the width of each rib 3; the rib 3 is fixedly connected at the lower end with a connection ring 4, whose diameter is smaller than that of the outlet pipe 2; the extension direction of the rib 3 and the longitudinal axis direction of the outlet pipe 2 may either form an acute angle or be the same.

While in use, a vacuum cleaning pipe is connected to the inlet pipe 8, from which dirty air enters the air inlets 10*s* of the two cup covers 9*s*, respectively; the rough dust is filtered out by the net filtering tube 11, and falls down to bottom of the cup body 12; the fine dust and air enter the cyclone cylinder 1 via the cyclone inlet 6 and form cyclone; in the cyclone process, the fine dust falls along the inner wall of the cyclone cylinder 1 and arrives at bottom of the dust-collecting bucket 7 via the dust-falling ring gap 13, and the air after dust removal is then discharged upwards out of the outlet pipe 2 via the air outlet 14.

The present embodiment provides the helicoid 5 oriented downwards on the side of the outlet pipe, making the air entering from the cyclone inlet 6 form cyclone quickly and flow downwards, preventing it from colliding with the air entering afterwards, thus likewise lowering the noise.

Embodiment 2

Figure 4:
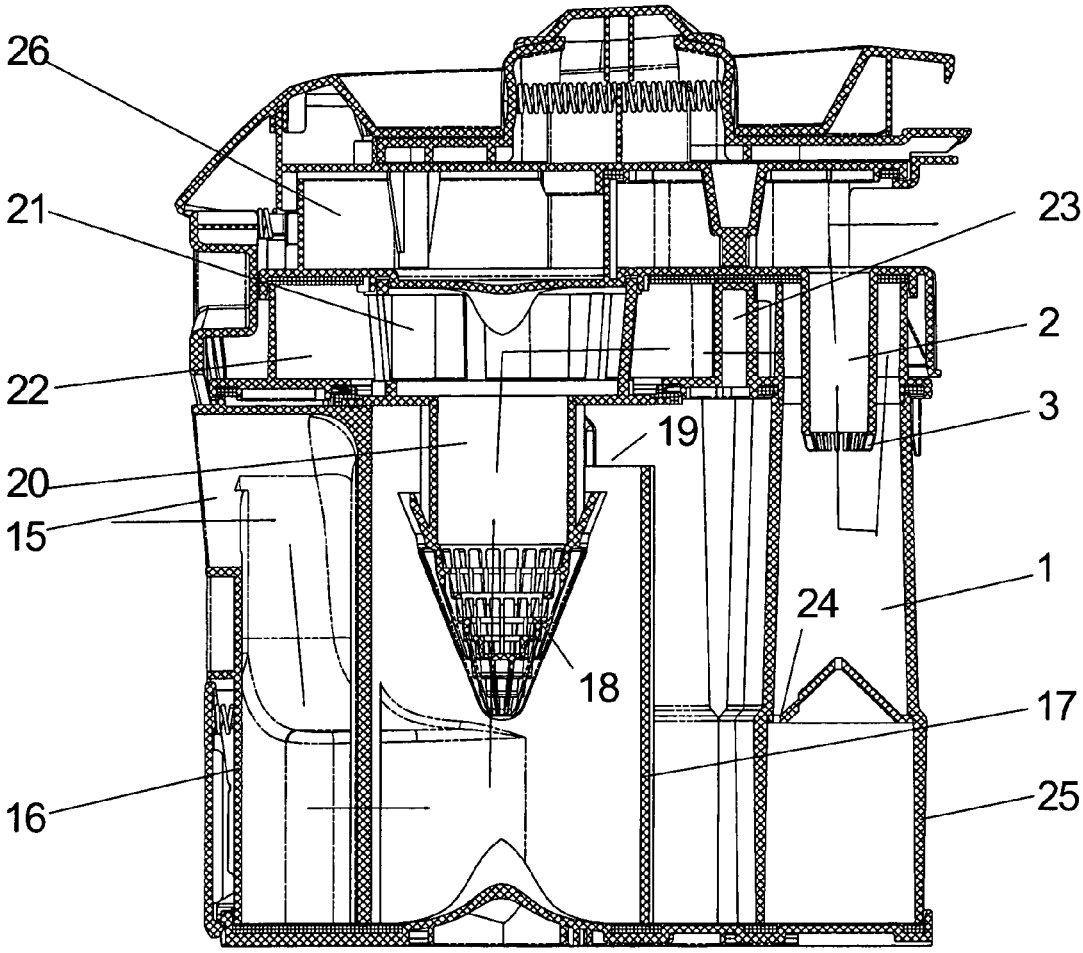
FIG. 4 is a structural schematic view of Embodiment 2.
Figure 5:
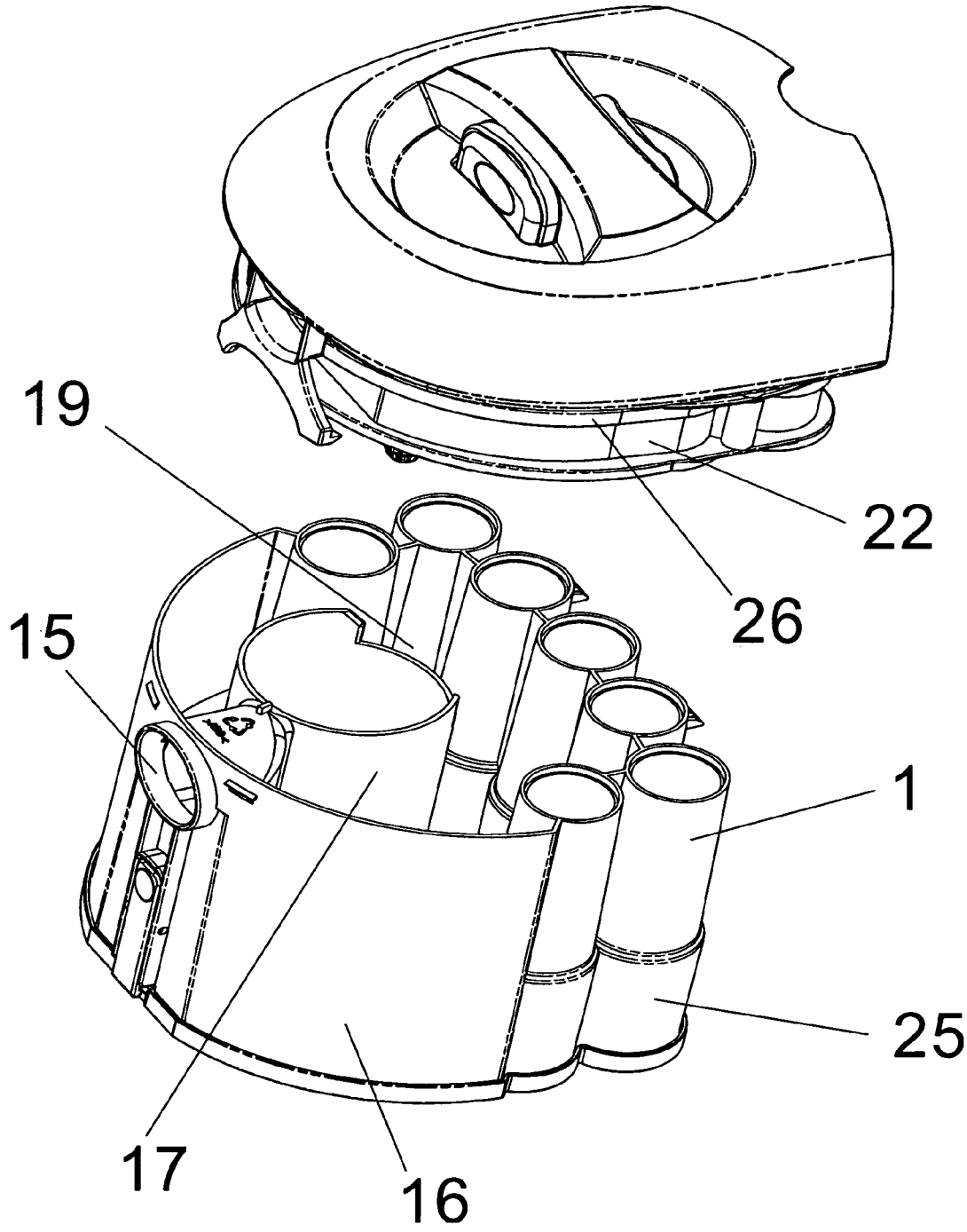
FIG. 5 is an assembly drawing of FIG. 4.
Figure 6:
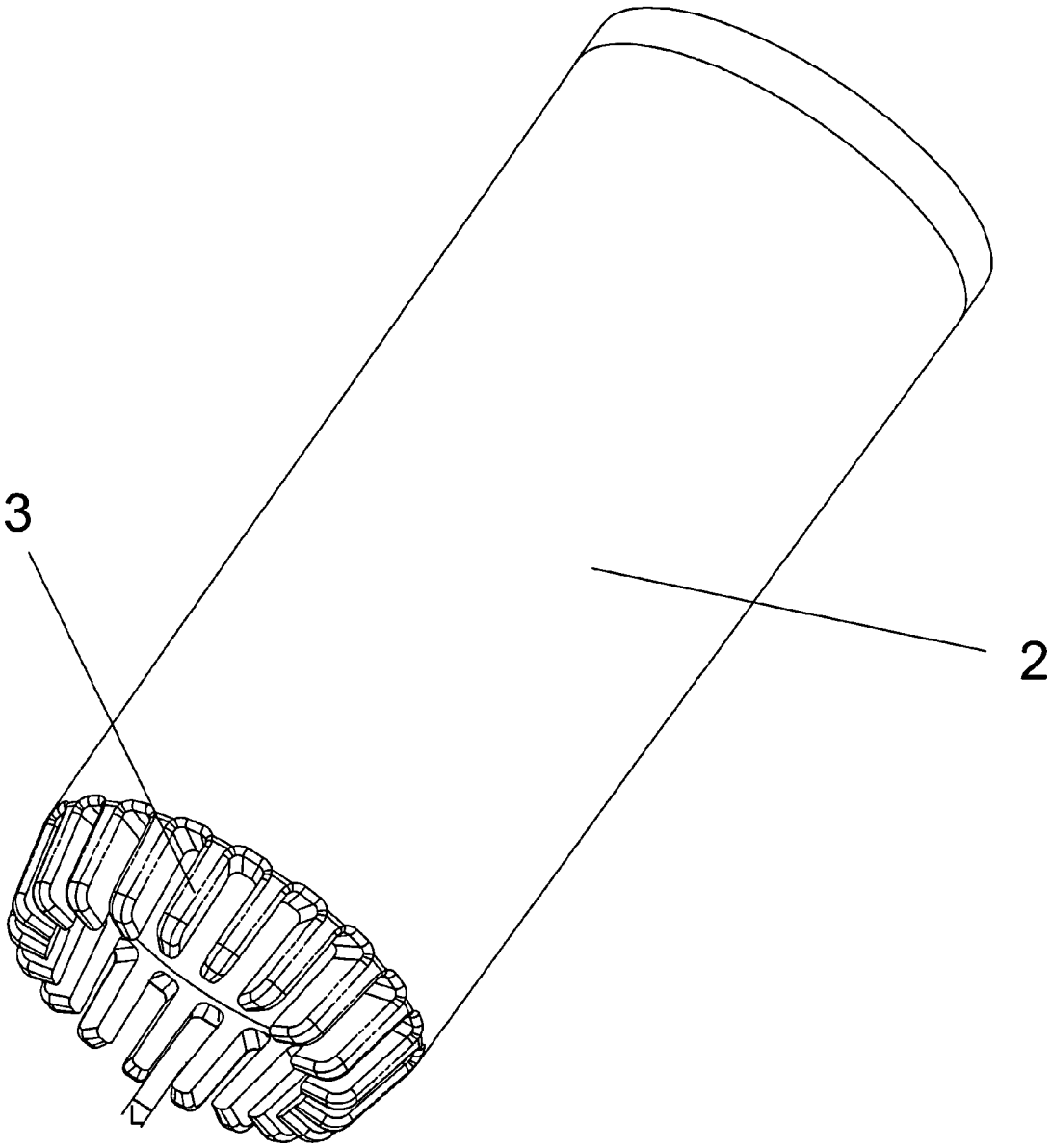
FIG. 6 is a schematic view of the outlet pipe of Embodiment 2.

As shown in FIGS. 4 to 6, a cyclone silencer of cleaner is provided, which includes an outlet pipe 2 partly extended into a cyclone cylinder 1; the outlet pipe 2 is provided at the lower edge with some parallel spaced arc ribs 3*s* extending downwards, the rib 3 and the lower head face of the outlet pipe 2 forming an angle smaller than or equal to 90 degrees.

A dust removing device of cleaner is provided, which includes a cyclone cylinder 1, communicated with which are a cyclone inlet 6 and an outlet pipe 2; the outlet pipe 2 is positioned longitudinally, and provided at the lower edge with some parallel spaced ribs 3*s* extending downwards; the spacing between the adjacent ribs 3*s* is smaller than the length of each rib 3, and bigger than the width of each rib 3; the extension direction of the rib 3 and the longitudinal axis direction of the outlet pipe 2 may either form an acute angle or be the same.

While in use, the dirty air included with dust enters the tube body 17 in the primary dust cup 16 from the primary air inlet 15; the rough dust falls in the tube body 17 when going through the conical filtering tube 18, part of the rough dust entering the primary dust cup 16 via the notch 19 at the upper edge of the tube body 17; the fine dust and air keep on entering the filtering tube 18 and, after being further filtered by the strainer 21 upwards from the primary air outlet 20, enter the communicating layer 22, and then keep on entering each of the cyclone cylinders is from each of the secondary air inlets 23*s* and forming cyclone; in the cyclone process, the fine dust falls along the inner wall of the tube body, and enters the secondary dust cup 25 via the dust-falling ring gap 24; the air after dust removal then enters the outlet layer 26 upwards from the secondary outlet pipe 2, and is discharged in a concentrated way from an exhaust pipe on the outlet layer 26.

The present invention provides some ribs 3*s* at the lower edge of the outlet pipe 2, and the ribs 3*s* are spaced from each other; gas stream will contract when entering the space of the ribs 3*s*, and expand when getting out of the space of the ribs 3*s*, thus noise of the gas stream being lowered. Refer to U.S. Pat. No. 6,932,188 in the name of the applicant for this lowering-noise technology. The inventor found in the experiments that high-frequency noise of the cyclone vacuum cleaner could be remarkably lowered when the spacing L between the adjacent ribs 3*s* is smaller than length of each rib 3 and bigger than width of each rib 3.

What mentioned above is only an embodiment of the present invention, and cannot limit the extent of protection of the present invention. The present invention can also have other embodiments in addition to the above-mentioned embodiments. Any technical solution based on equal substitution or equivalent transform all falls within the extent of protection the present invention requires.

The invention claimed is:

1. A cyclone silencer of a cleaner comprising:

an outlet pipe (2) partly extended into a Cyclone cylinder (1); wherein the outlet pipe (2) is provided in the lower edge thereof with some parallel spaced ribs (3s) extending downwards.

2. The cyclone silencer as claimed in claim 1, wherein the rib (3) and the lower head face of the outlet pipe (2) form an angle smaller than or equal to 90 degrees.

3. The cyclone silencer as claimed in claim 1, wherein the rib (3) is of an arc form.

4. The cyclone silencer as claimed in claim 1, wherein the outlet pipe (2) is provided on the outer wall with a helicoid (5) orientated downwards.

5. The cyclone silencer as claimed in claim 1, wherein the lower ends of the adjacent ribs (3) are connected with each other to form a connection ring (4).

6. The cyclone silencer as claimed in claim 5, wherein the rib (3) and the lower head face of the outlet pipe (2) form an angle smaller than or equal to 90 degrees.

7. The cyclone silencer as claimed in claim 5, wherein the rib (3) is of an arc form.

8. The cyclone silencer as claimed in claim 5, wherein the outlet pipe (2) is provided on the outer wall with a helicoid (5) orientated downwards.

9. A dust removing device of cleaner, wherein the dust remover includes the Cyclone cylinder (1), communicated with which are a cyclone inlet (6) and the outlet pipe (2); the outlet pipe (2) is positioned longitudinally, and provided in the lower end with some parallel spaced ribs (3s) extending downwards.

10. The dust removing device of cleaner as claimed in claim 9, wherein the extension direction of the rib (3) and the longitudinal axis direction of the outlet pipe (2) form an acute angle.

11. The dust removing device of cleaner as claimed in claim 9, wherein the extension direction of the rib (3) and the longitudinal axis direction of the outlet pipe (2) are the same.

12. The dust removing device of cleaner as claimed in claim 9, wherein the spacing between the adjacent ribs (3) is smaller than the length of each rib (3), and bigger than the width of each rib (3).

13. The dust removing device of cleaner as claimed in claim 9, wherein the rib (3) is fixedly connected at the lower end to form a connection ring (4), whose diameter is smaller than that of the outlet pipe (2).

* * * * *